US006500015B2

(12) United States Patent
Fukamachi et al.

(10) Patent No.: US 6,500,015 B2
(45) Date of Patent: Dec. 31, 2002

(54) CONNECTOR

(75) Inventors: Makoto Fukamachi, Yokkaichi (JP); Matthew Grant, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/949,674

(22) Filed: Sep. 12, 2001

(65) Prior Publication Data

US 2002/0031927 A1 Mar. 14, 2002

(30) Foreign Application Priority Data

Sep. 13, 2000 (JP) ..... 2000-278439

(51) Int. Cl.[7] ..... H01R 13/62
(52) U.S. Cl. ..... 439/157; 439/372
(58) Field of Search ..... 439/157, 924.1, 439/924.2, 372, 152, 153, 347

(56) References Cited

U.S. PATENT DOCUMENTS 5,135,410 A 8/1992 Kawase et al. ..... 439/372
5,385,870 A 1/1995 Maue et al. ..... 439/157
5,431,573 A * 7/1995 Endo et al. ..... 439/157
5,727,959 A 3/1998 Yagi et al. ..... 439/157

FOREIGN PATENT DOCUMENTS

| | | |
|---|---|---|
| EP | 0 793 304 A2 | 9/1997 |
| EP | 0 793 304 A3 | 12/1999 |
| JP | 2-56877 | 2/1990 |

* cited by examiner

*Primary Examiner*—P. Austin Bradley
*Assistant Examiner*—Ross Gushi
(74) *Attorney, Agent, or Firm*—Banner & Witcoff, Ltd.

(57) ABSTRACT

The invention provides a means of reducing the force required for fitting a lever connector. A connector 20 is divided into partitioned housings 22L and 22R. The timing of the fitting operation differs for each of the partitioned housings 22L and 22R, thereby causing the time at which peak fitting resistance occurs to differ. The peak fitting resistance being dispersed over the period between the beginning and the ending of the fitting operations of the two partitioned housings 22L and 22R. As a result, the overall peak value of the fitting resistance (the force required for the fitting operation) is reduced for the connector as a whole.

12 Claims, 11 Drawing Sheets

CONNECTOR

TECHNICAL FIELD

The present invention relates to a connector wherein the force required for a fitting operation is reduced.

BACKGROUND TO THE INVENTION

Friction between terminal fittings causes multipolar connectors to have a high fitting resistance. In order to deal with this, one connector may be provided with a lever, and the other connector provided with cam pins. The lever is moved after the cam pins have been fitted into cam grooves, the cam operation thereby reducing the force required for the fitting operation.

In this type of connector, the cam operation of the lever is used to reduce the force required for the fitting operation, and the operating force increases commensurately with the number of terminal fittings. Since connectors having several dozen terminal fittings have recently come into common use, a means is required which will further reduce the operating force.

The present invention has taken the above problem into consideration, and aims to present a connector wherein the force for the fitting operation is reduced.

SUMMARY OF THE INVENTION

According to the invention there is provided a connector assembly comprising a first connector having first connector portions, a second connector having second connector portions for respective engagement with said first connector portions, a plurality of cams being provided on one of said first and second connectors, each cam corresponding with respective connector portions, cam followers being provided on the other of said first and second connectors and for co-operation with a respective cam, such that movement of the cams draws said connector portions into engagement, wherein said cams and cam followers have a different timing whereby respective connector portions are engaged in a predetermined sequence.

Such an arrangement reduces the peak fitting force by separating the connection sequence of the connector portions. Accordingly the initial relatively high connection force, as the terminals make initial engagement, is distributed.

The cams may be pivotable or slidable linearly. The cams may be actuated in sequence, or may define different shaped tracks. The cam followers may be engaged sequentially. In the case of pivotable cams, a control mechanism may be provided to ensure the desired movement sequence as the connectors are engaged.

BRIEF DESCRIPTION OF DRAWINGS

Other features of the invention will be apparent from the following description of preferred embodiments shown by way of example only in the accompanying drawings in which.

DESCRIPTION OF PREFERRED EMBODIMENTS

A first embodiment of the invention is described below with the aid of FIGS. 1 to 4.

A connector assembly is formed from a first connector 10 and a second connector 20. The second connecor 20 is provided with two partitioned left and right housings 22L and 22R capable of being fitted separately to the first connector10, and two left and right levers 24L and 24R that correspond respectively to the partitioned housings 22L and 22R. In the following description, the left-right direction is with respect to the first connector 10. That is, the left-right direction of the second connector 20 is that of the first connector 10.

Figure 1:
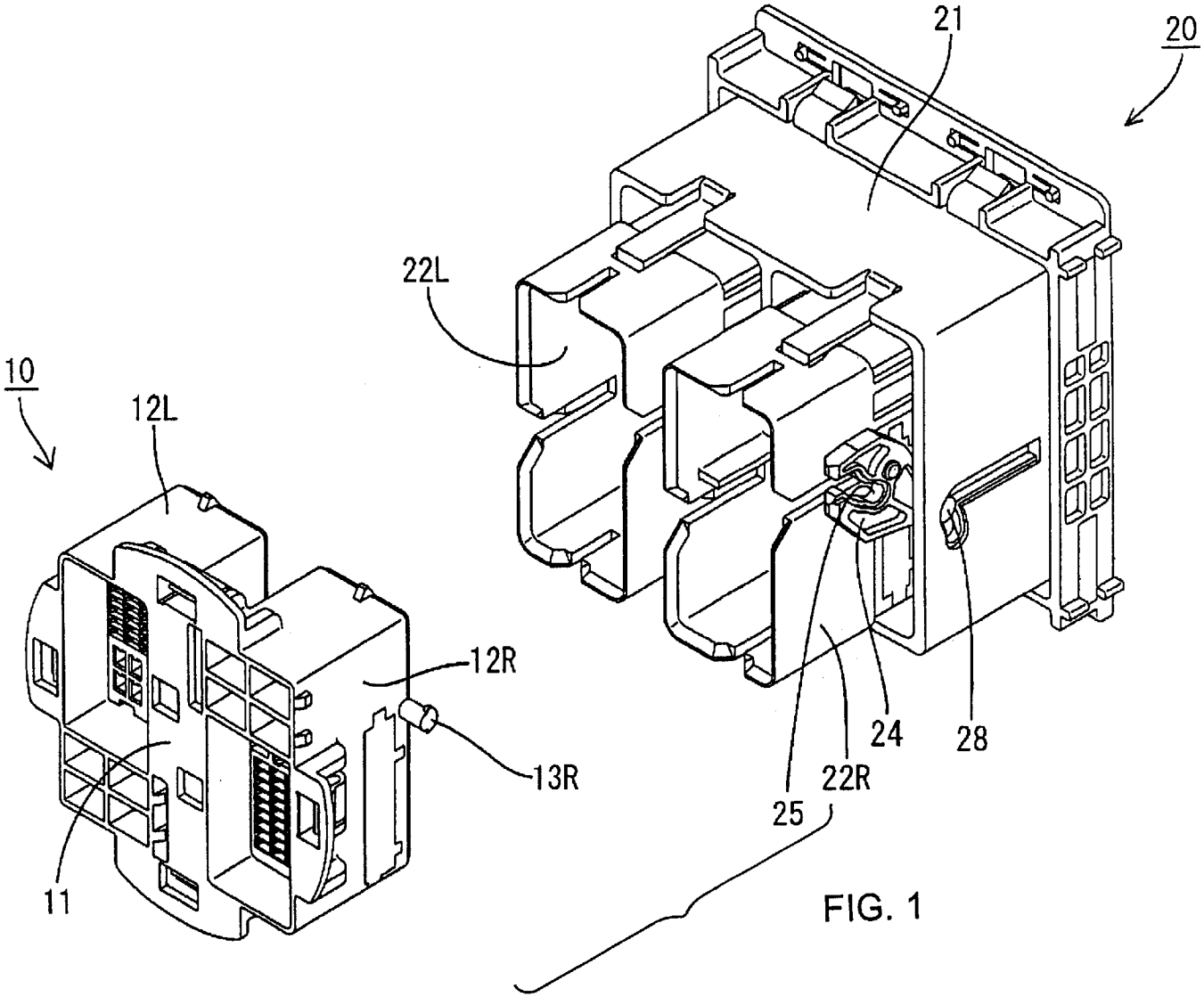
FIG. 1 is a diagonal view of a first embodiment showing a state prior to fitting.

The first connector 10 has a shape whereby left and right fitting members 12L and 12R protrude in an anterior direction from a base member 11. A plurality of terminal fittings (not shown) are housed within these fitting members 12L and 12R. Cam followers 13L and 13R, which are provided coaxially and have a long and narrow cylindrical shape, protrude from left and right side faces of the fitting members 12L and 12R. The cam followers 13L and 13R are also provided coaxially between the fitting members 12L and 12R. In FIG. 1, only the right cam follower 13R provided on the right side face of the fitting member 12R is shown.

The second connector 20 is provided with a housing main body 21 and the two partitioned left and right housings 22L and 22R, these being supported in the housing main body 21 in a manner whereby they can move in an anterior-posterior direction (that is, in a direction parallel to the fitting direction with the first connector 10). Each of the partitioned left and right housings 22L and 22R can move separately in an anterior-posterior direction. A pair of supporting axes 23L and 23R protrude in a coaxial manner on left and right side faces of each of the partitioned left and right housings 22L and 22R. These supporting axes 23L and 23R are also coaxial with the left and right fitting members 12L and 12R.

The pair of levers 24L and 24R, which can be rotated using the supporting axes 23L and 23R as their centre, are supported on each of the partitioned left and right housings 22L and 22R. A cam groove 25 is formed in each of the levers 24L and 24R. These cam grooves 25 have an approximate arc shape and are located along side the supporting axes 23L and 23R. Each cam groove 25 has an opening 26 that is open to an outer circumference of the levers 24L and 24R. Fitting grooves 27, which are formed so as to adjoin inner ends of the cam grooves 25 (i.e., the opposite ends to the openings 26), have an arc shape, with the supporting axes 23L and 23R serving as their centre.

Moreover, a guiding pin 28 protrudes outwards from each lever 24L and 24R at a location at the opposite end to the opening 26 of each cam groove 25, the supporting axes 23L and 23R being located therebetween. When viewed from the side, the shape and location of the cam grooves 25, as well as the location of the guiding pins 28, is identical in both levers 24L and 24R.

Figure 2:
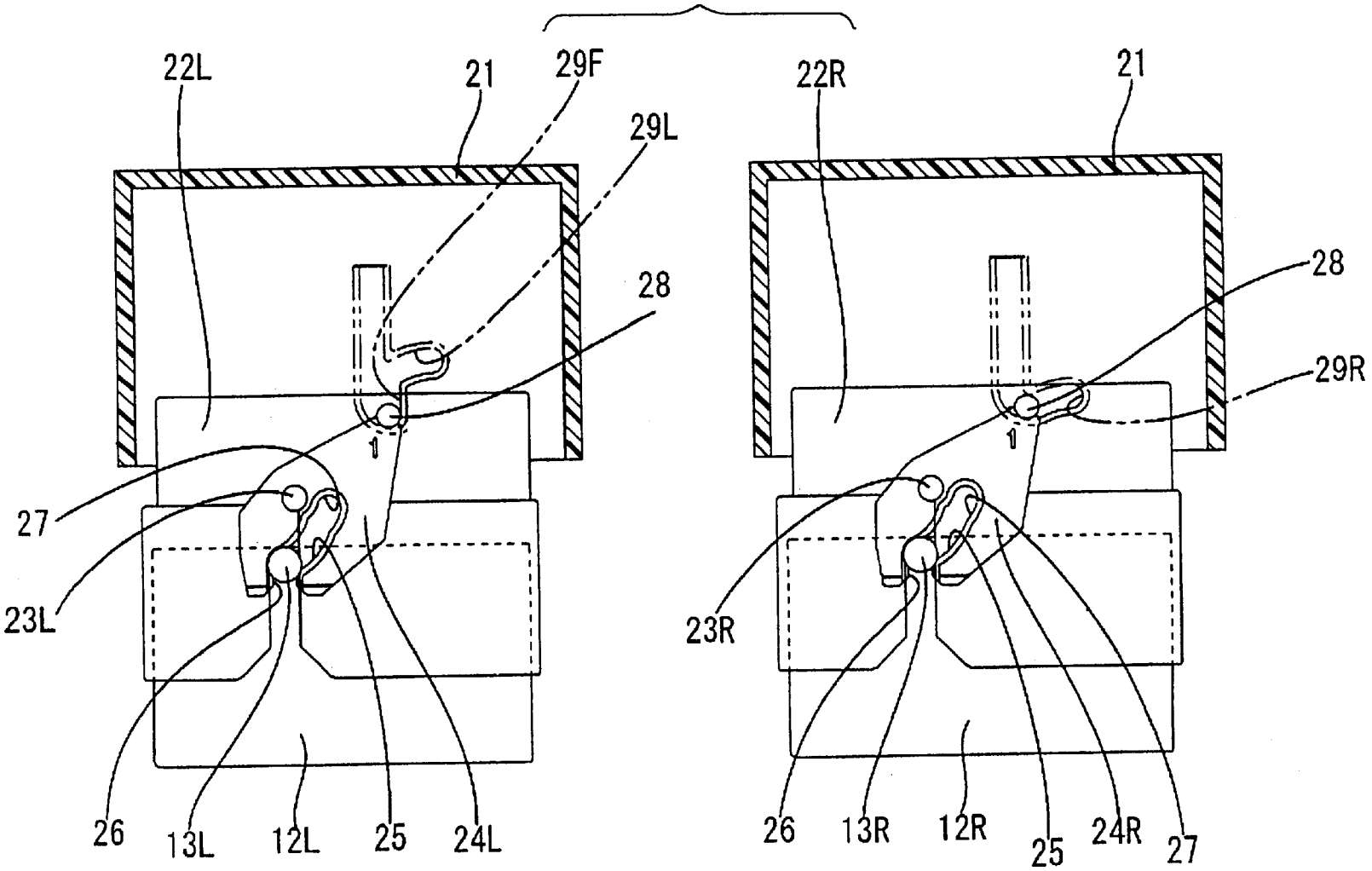
FIG. 2 is a schematic view showing cam movement and the fitting state of partitioned housings at the beginning of a fitting operation.
Figure 4:
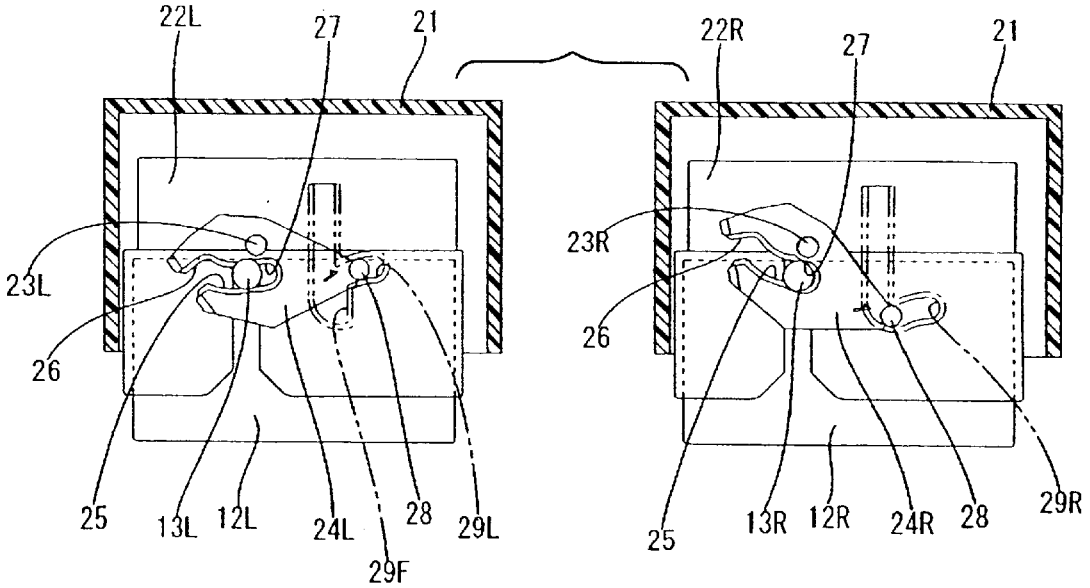
FIG. 4 is a schematic view showing cam movement and the fitting state of the partitioned housings at the end of the fitting operation.

As shown in FIG. 2, when the levers 24L and 24R are in a waiting position before the fitting operation of the partitioned housings 22L and 22R commences, the openings 26 of the cam grooves 25 of these levers 24L and 24R are open in the direction of the first connector 10, the guiding pins 28 waiting in a location at a posterior end relative to the fitting direction with the first connector 10. As shown in FIG. 4, when the fitting operation of the partitioned housings 22L and 22R has been completed, the levers 24L and 24R have been rotated by approximately 90 degrees with respect to the waiting position.

A pair of left guiding grooves 29L and a pair of right guiding grooves 29R are formed in the housing main body 21. The guiding pins 28 of the levers 24R of the right fitting member 12R fit into the right guiding grooves 29R. The guiding pins 28 of the levers 24L of the left fitting member 12L fit into the left guiding grooves 29L. Both right guiding grooves 29R are identical in shape and location, and both left guiding grooves 29L are identical in shape and location. However, the right guiding grooves 29R are not located in the same position as the left guiding grooves 29L. That is, the right guiding grooves 29R are located further towards the posterior, relative to the fitting direction with the first connector 10, and fitting grooves 29F adjoin base end portions of the left guiding grooves 29L, these fitting grooves 29F extending in a straight line parallel with the fitting direction with the first connector 10.

Next, the operation of this embodiment will be described. As shown in FIG. 2, when the two connectors 10 and 20 are to be fitted together, both partitioned housings 22L and 22R are temporarily maintained in the waiting position, and the openings 26 of the cam grooves 25 of the levers 24L and 24R are temporarily maintained so as to be open in the direction of the first connector 10. In this state, the partitioned housings 22L and 22R are both shallowly fitted to the fitting members 12L and 12R of the first connector 10. Then the cam followers 13L and 13R are inserted into the openings 26 of the cam grooves 25.

Next, from this state, the housing main body 21 is moved towards the first connector 10. Then, the guiding pins 28 of the right partitioned housing 22R are first fitted into the right guiding grooves 29R, this causing the rotating operation of the right lever 24R to begin. While the right lever 24R is rotated, the right cam followers 13R begin to be fitted into the cam grooves 25. The cam operation resulting from the right cam followers 13R being fitted into the cam grooves 25 causes the right partitioned housing 22R to be drawn towards the first connector 10. In this manner, the right partitioned housing 22R is fitted to the right fitting member 12R. While this occurs, the left guiding pins 28 move above the fitting grooves 29F. Consequently, the left levers 24L are not rotated, and the left partitioned housing 22L is not yet fitted with the fitting member 12L.

Figure 3:
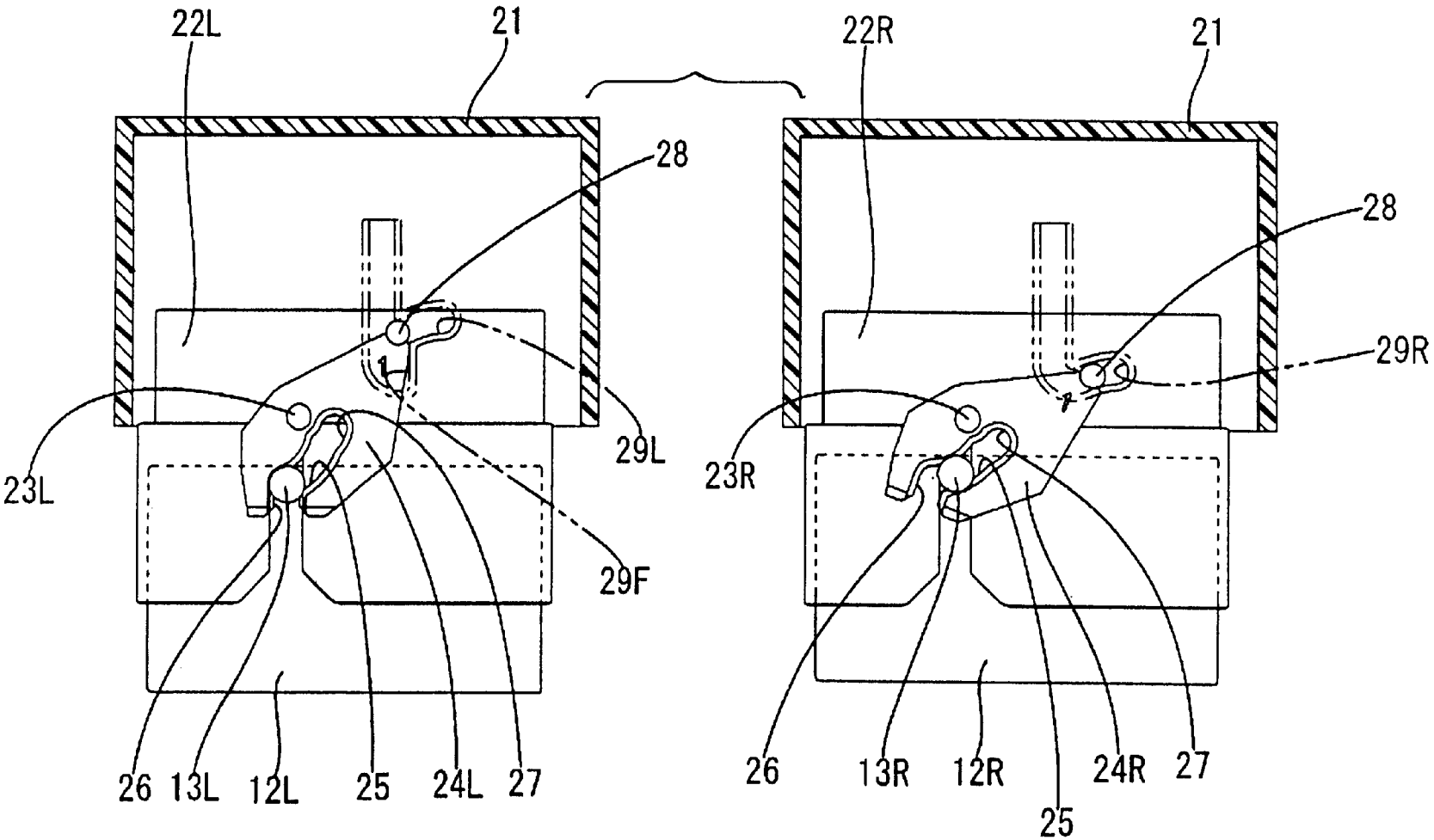
FIG. 3 is a schematic view showing cam movement and the fitting state of the partitioned housings part-way through the fitting operation.

As shown in FIG. 3, when the right partitioned housing 22R has been fitted to a certain degree to the right fitting member 12R, the left guiding pins 28 reach the fitting grooves 29L. At this juncture, the right fitting operation continues, while simultaneously, at the left side, the left guiding pins 28 are fitted into the left guiding grooves 29L, this causing the rotating operation of the left lever 24L to begin. The cam followers 13L are fitted into the cam grooves 25, this causing the left partitioned housing 22L to be fitted to the left fitting member 12L.

While the fitting operation of the left partitioned housing 22L and the left fitting member 12L is continuing, the fitting operation of the right partitioned housing 22R and the right fitting member 12R is completed. Next, the right cam followers 13R are moved from the cam grooves 25 to the fitting grooves 27, this halting the cam operation on the right side. The fitting operation caused by the cam operation now continues only on the left side. As shown in FIG. 4, when the fitting operation on the left side is completed, the left cam followers 13L are in an ending position within the guiding grooves 29L.

In this manner, when fitting occurs, the fitting operation of the right partitioned housing 22R and the fitting member 12R begins first. Then, while this fitting operation takes place, the fitting operation of the left partitioned housing 22L and the fitting member 12L begins. The fitting of the right side is completed first, and the fitting of the left side is completed thereafter. Moreover, when the two connectors 10 and 20 are to be separated, the process takes place in the reverse order to that described above. That is, the separating operation of the left partitioned housing 22L begins first, and while this separating operation takes place, the separating operation of the right partitioned housing 22R begins. The separation of the left side is completed first, and the separation of the right side is completed thereafter.

In the embodiment described above, the left and right partitioned housings 22L and 22R of the second connector 20 are separate. Consequently, the number of terminal fittings, and the peak value of the fitting resistance is reduced in each individual partitioned housings 22L and 22R. Furthermore, the left and right levers 24L and 24R (the cam grooves 25) begin and finish moving at mutually differing times, this causing the timing of the fitting operations of the two partitioned housings 22L and 22R to differ. Consequently, the time at which fitting resistance occurs differs for each of the two partitioned housings 22L and 22R, the peak fitting resistance being dispersed over the period between the beginning and the ending of the fitting operations of the two partitioned housings 22L and 22R. As a result, the peak value of the fitting resistance (the force required for the fitting operation) is reduced for the connector as a whole.

A second embodiment of the invention is described below with the aid of FIGS. 5 to 8.

In embodiment 2, the timing of the fitting operation of each left and right partitioned housing 22L and 22R differs as a result of using a means which has a different configuration from that of embodiment 1. The remaining configuration is the same as embodiment 1 and accordingly the same symbols are used and an explanation of the structure, operation and effects thereof is omitted.

In the first embodiment, each left lever 24L had the same shape, as did each right lever 24R, and the cam grooves 25 thereof. Moreover, the timing of the fitting operations of the partitioned housings 22L and 22R was made to differ as a result of the left and right levers 24L and 24R beginning and ending their movement at mutually differing times. In embodiment 2, left and right levers 31L and 31R are rotated with the same timing (although this is not shown, the configuration of guiding grooves thereof is identical at both left and right sides), and the timing of the fitting operations of the partitioned housings 22L and 22R is made to differ as a result of cam grooves 32L and 32R (these correspond to the cams of the present invention) having mutually differing shapes.

That is, the cam groove 32R of the right lever 31R has an opening 32RE that opens out towards an outer circumference of the lever 31R, a fitting groove member 32RF that adjoins an innermost side of the opening 32RE, and a cam operating member 32RC that adjoins an innermost side of the fitting member 32RF. The cam groove 32L of the left lever 31L has an opening 32LE that opens out towards an outer circumference of the lever 31L, a cam operating member 32LC that adjoins an innermost side of the opening 32LE and a fitting groove member 32LF that adjoins an innermost side of the cam operating member 32LC That is, the position of the fitting groove members 32LF and 32RF and the cam operating members 32LC and 32RC, these being located above the fitting paths of the cam followers 13L and 13R, are mutually reversed on the left and right sides. If either the left lever 31L or the right lever 31R is rotated while the cam followers 13L or 13R are fitted with the fitting groove members 32LF or 32RF respectively, the cam operation does not occur. However, if the left lever 31L or the right lever 31R is rotated while the cam followers 13L or 13R are fitted with the cam operating members 32LC or 32RC respectively, the cam operation does occur.

Figure 5:
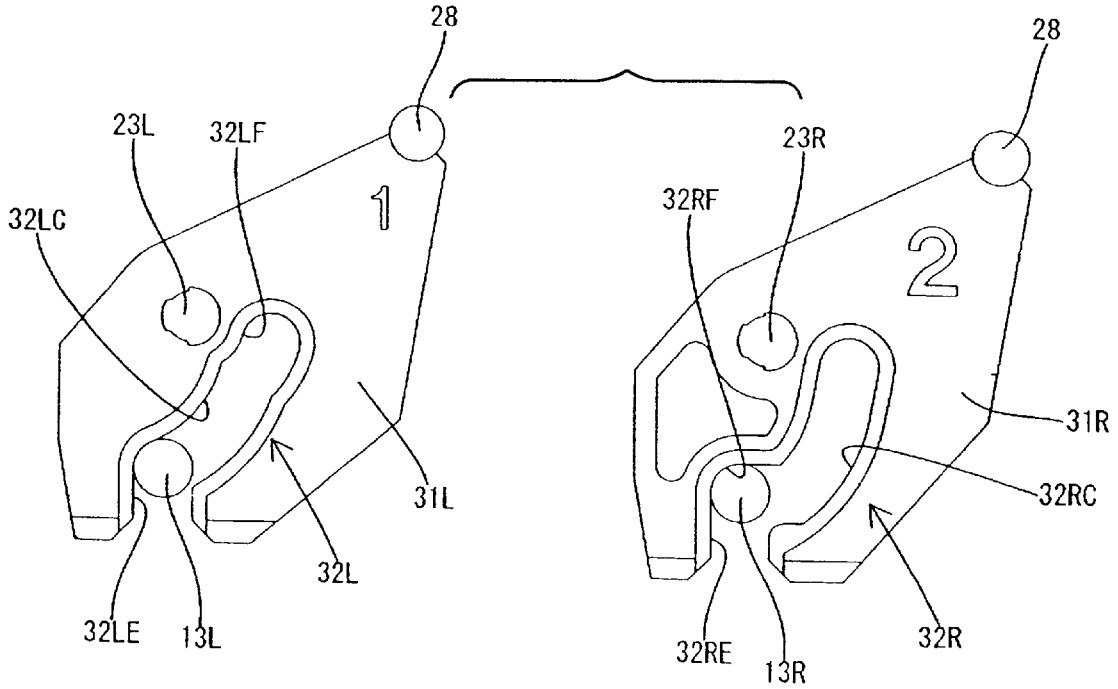
FIG. 5 is a schematic view showing cam movement and the fitting state of partitioned housings at the beginning of a fitting operation of a second embodiment.

As is the case with the first embodiment, when the two connectors 10 and 20 are to be fitted together, the two partitioned housings 22L and 22R are first maintained in a waiting position, and the levers 31L and 31R are temporarily maintained in a position whereby the openings 32LE and 32RE of the cam grooves 32L and 32R are open in the direction of the first connector 10 (this is located at the lower side in FIGS. 5 to 8). In this state, the partitioned housings 22L and 22R are both shallowly fitted to the fitting members 12L and 12R of the first connector 10. Then, as shown in FIG. 5, the cam followers 13L and 13R are inserted into the openings 32LE and 32RE of the cam grooves 32L and 32R.

From this state, the housing main body 21 is moved towards the first connector 10, while the left and right levers 31L and 31R are simultaneously rotated. Next, the cam operating members 32LC of the left lever 31L are firstly fitted with the cam followers 13L, and the cam operation begins, this drawing the left partitioned housing 22L towards the first connector 10, thereby fitting the left partitioned housing 22L with the fitting member 12L. Meanwhile, in the right lever 31R, the cam followers 13R are moved into the fitting groove members 32RF, and the cam operation does not occur. As a result, the right partitioned housing 22R and the fitting member 12R are not yet fitted together.

Figure 6:
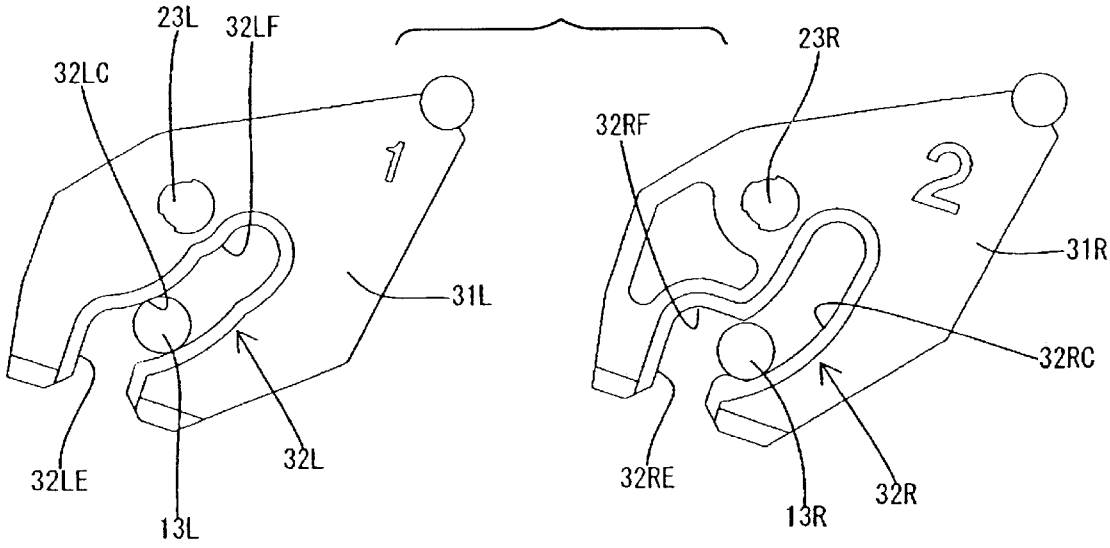
FIG. 6 is a schematic view showing cam movement and the fitting state of the partitioned housings part-way through the fitting operation.

Next, as shown in FIG. 6, when the left partitioned housing 22L has been fitted to a certain degree to the fitting member 12L, the right cam followers 13R reach the cam operating members 32RC. At this juncture, the left fitting operation continues, while simultaneously, at the right side, the right cam followers 13R are fitted into the cam operating members 32RC, this causing the right partitioned housing 22R to be fitted to the right fitting member 12R.

Figure 7:
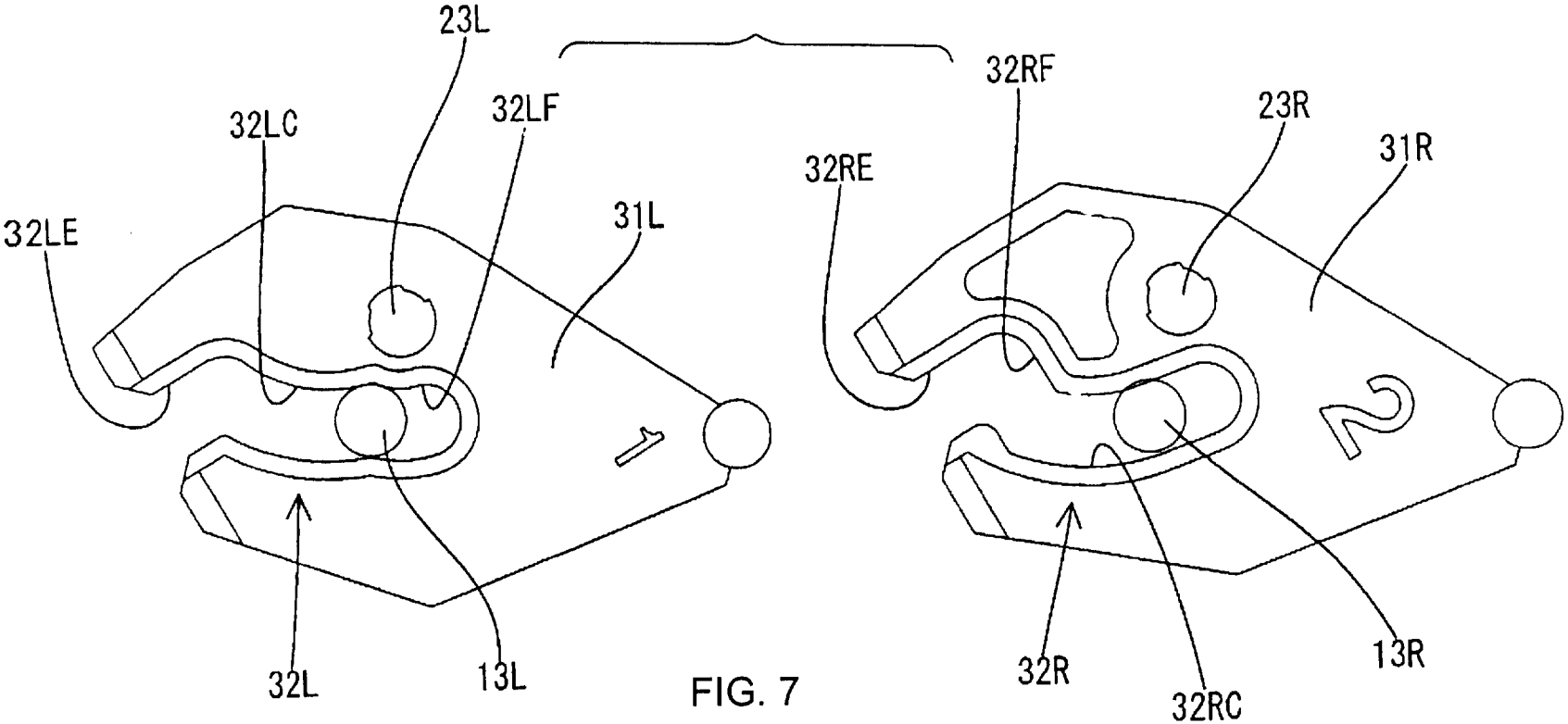
FIG. 7 is a schematic view showing cam movement and the fitting state of the partitioned housings part-way through the fitting operation.
Figure 8:
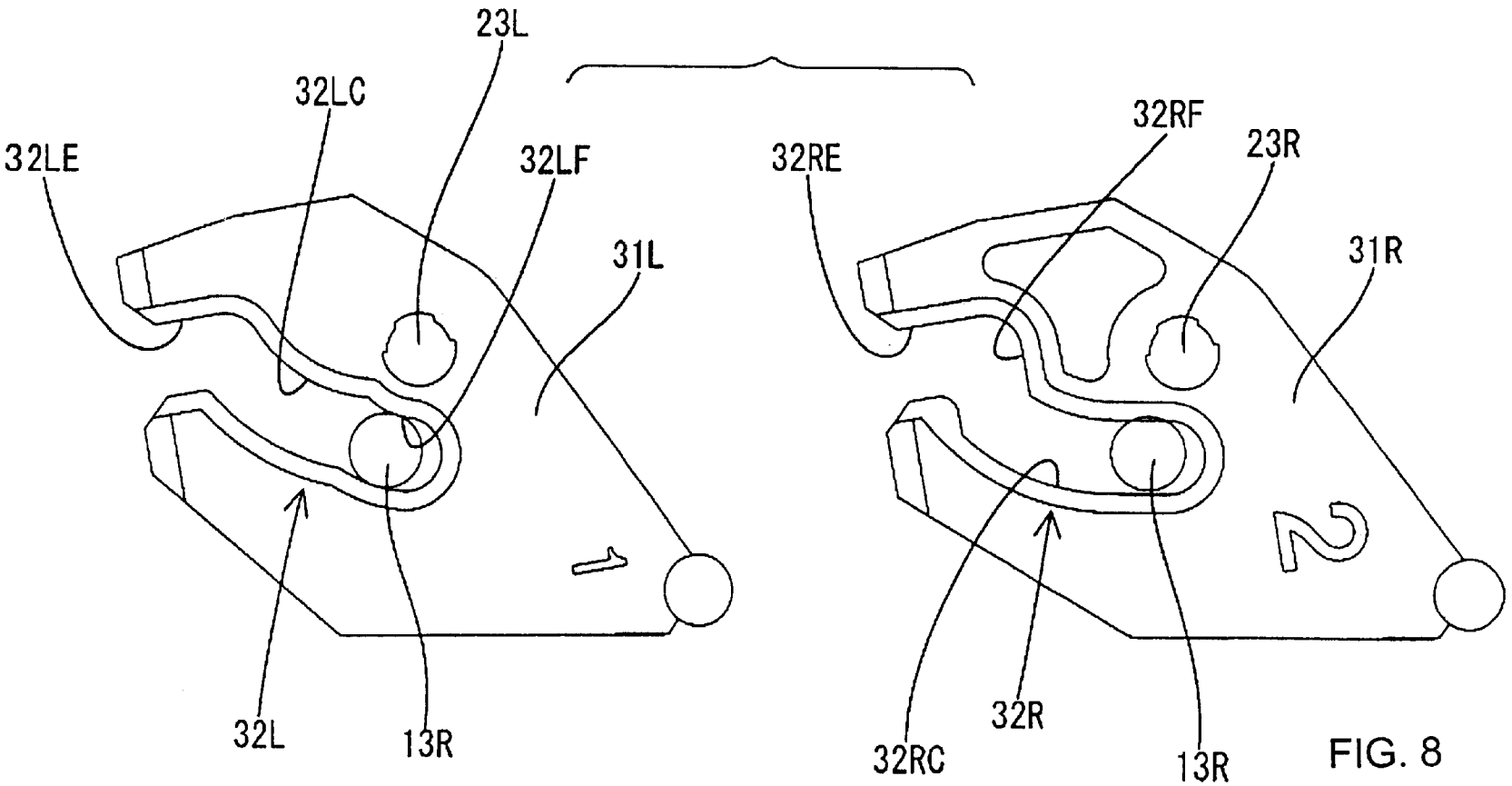
FIG. 8 is a schematic view showing cam movement and the fitting state of the partitioned housings at the end of the fitting operation.

While the fitting operation of the right partitioned housing 22R and the right fitting member 12R is continuing, the fitting operation of the left partitioned housing 22L and the left fitting member 12L is completed (see FIG. 7). Next, the cam followers 13L in the left lever 31L move from the cam operating members 32LC to the fitting groove members 32LF this halting the cam operation on the left side. The fitting operation, which is caused by the cam operation, now continues only on the right side. Then, the fitting operation on the right side is also completed (see FIG. 8).

In this manner, when fitting occurs, the fitting operation of the left partitioned housing 22L and the fitting member 12L begins first. Then, while this fitting operation takes place, the fitting operation of the right partitioned housing 22R and the fitting member 12R begins. The fitting of the left side is completed first, and the fitting of the right side is completed thereafter. Moreover, when the two connectors 10 and 20 are to be separated, the process takes place in the reverse order to that described above. That is, the separating operation of the right partitioned housing 22R begins first, and while this separating operation takes place, the separating operation of the left partitioned housing 22L begins. The separation of the right side is completed first, and the separation of the left side is completed thereafter.

In the embodiment described above, the left and right partitioned housings 22L and 22R of the second connector are separate. Consequently, the number of terminal fittings, and the peak value of the fitting resistance is reduced in each individual partitioned housing 22L and 22R. Furthermore, the left and right cam grooves 32L and 32R have mutually differing shapes, this causing the timing of the fitting operations of the two partitioned housings 22L and 22R to differ. Consequently, the time at which fitting resistance occurs differs for each of the two partitioned housings 22L and 22R, the peak fitting resistance being dispersed over the period between the beginning and the ending of the fitting operations of the two partitioned housings 22L and 22R. As a result, the peak value of the fitting resistance (the force required for the fitting operation) is reduced for the connector as a whole.

Next a third embodiment of the invention is described below with the aid of FIGS. 9 to 12.

In this embodiment, as in the second embodiment, the timing of the fitting operation of each left and right partitioned housing. 22L and 22R differs as a result of using a configuration whereby left and right cam grooves 41L and 41R (these correspond to the cams of the present invention), have mutually differing shapes. The cam configuration differs from that of embodiment 2 due to the levers 40L and 40R. The remaining configuration is the same as embodiment 2 and accordingly the same symbols are used and an explanation of the structure, operation and effects thereof is omitted.

In the third embodiment, the levers 40L and 40R provided on the second connector 20 are moved in a direction at a right angle to the fitting direction of the two connectors 10 and 20 (the fitting direction is the up-down direction in FIGS. 9 to 12). Furthermore, cam grooves 41L and 41R are formed in left and right sides of the levers 40L and 40R. These left and right cam grooves 41L and 41R have mutually differing shapes. Each cam groove 41R of the right lever 40R has an opening 41RE that opens out towards an outer circumference of the lever 40R, a cam operating member 41RC that adjoins an innermost side of the opening 41RE and extends in a direction diagonal to the fitting direction, and a fitting groove member 41RF that adjoins an innermost side of the cam operating member 41RC and extends in a direction at a right angle to the fitting direction. Each cam groove 41L of the left lever 40L has an opening 41LE that opens out towards an outer circumference of the lever 40L, a fitting groove member 41LF that adjoins an innermost side of the opening 41LE and extends in a direction at a right angle to the fitting direction, and a cam operating member 41LC that adjoins an innermost side of the fitting groove member 41LF and extends in a direction diagonal to the fitting direction. The position of the fitting groove members 41LF and 41RF and the cam operating members 41LC and 41RC, these being located above the fitting paths of the cam followers 13L and 13R, are mutually reversed on the left and right sides. If either the left lever 40L or the right lever 40R is moved while the cam followers 13L or 13R are fitted with the fitting groove members 41LF or 41RF respectively, the cam operation does not occur. However, if the left lever 40L or the right lever 40R is moved while the cam followers 13L or 13R are fitted with the cam operating members 41LC or 41RC respectively, the cam operation does occur. Further, in embodiment 3, left and right sides are each provided with a pair of cam followers 13L and 13R respectively, and a pair of cam grooves 41L and 41R respectively.

Figure 9:
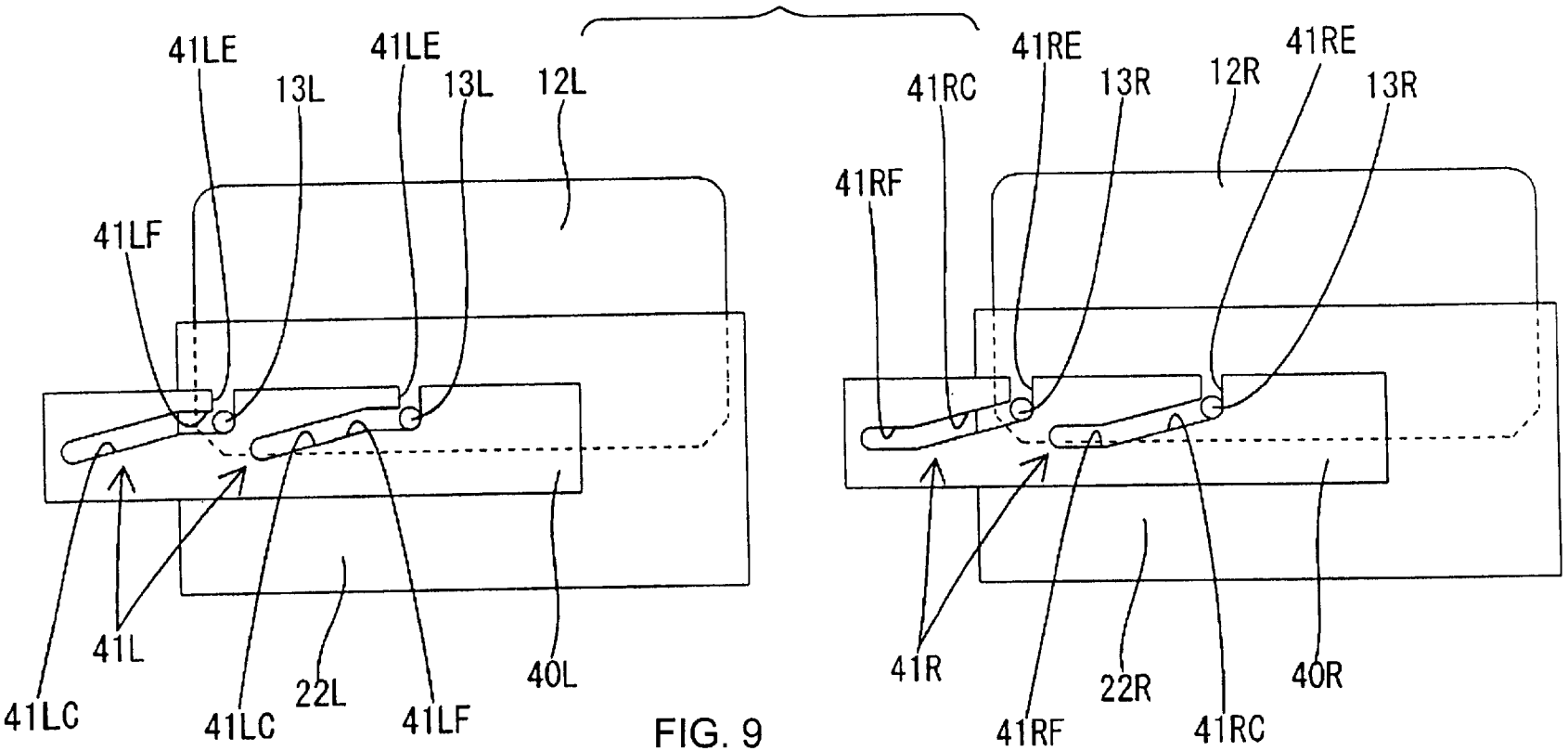
FIG. 9 is a schematic view showing cam movement and the fitting state of partitioned housings at the beginning of a fitting operation of a third embodiment.

As is the case with the first and second embodiments, when the two connectors 10 and 20 are to be fitted together, the two partitioned housings 22L and 22R are first maintained temporarily in a waiting position, and the levers 40L and 40R are temporarily maintained in a position whereby the openings 41LE and 41RE of the cam grooves 41L and 41R are open in the direction of the first connector 10 (this is located at the upper side in FIGS. 9 to 12). In this state, the partitioned housings 22L and 22R are both shallowly fitted to the fitting members 12L and 12R of the first connector 10. Then, as shown in FIG. 9, the cam followers 13L and 13R are inserted into the openings 41LE and 41RE of the cam grooves 41L and 41R.

From this state, the left and right levers 40L and 40R are simultaneously moved in a direction at a right angle to the fitting direction. Next, the cam operating members 41RC of the right lever 40R are first fitted with the cam followers 13R , and the cam operation begins, this drawing the right partitioned housing 22R and the right lever 40R towards the first connector 10, and thereby fitting the right partitioned housing 22R with the fitting member 12R. Meanwhile, in the left lever 40L, the cam followers 13L are moved into the fitting groove members 41LF, and the cam operation does not take place. As a result, the left partitioned housing 22L and the fitting member 12L are not yet fitted together.

Figure 10:
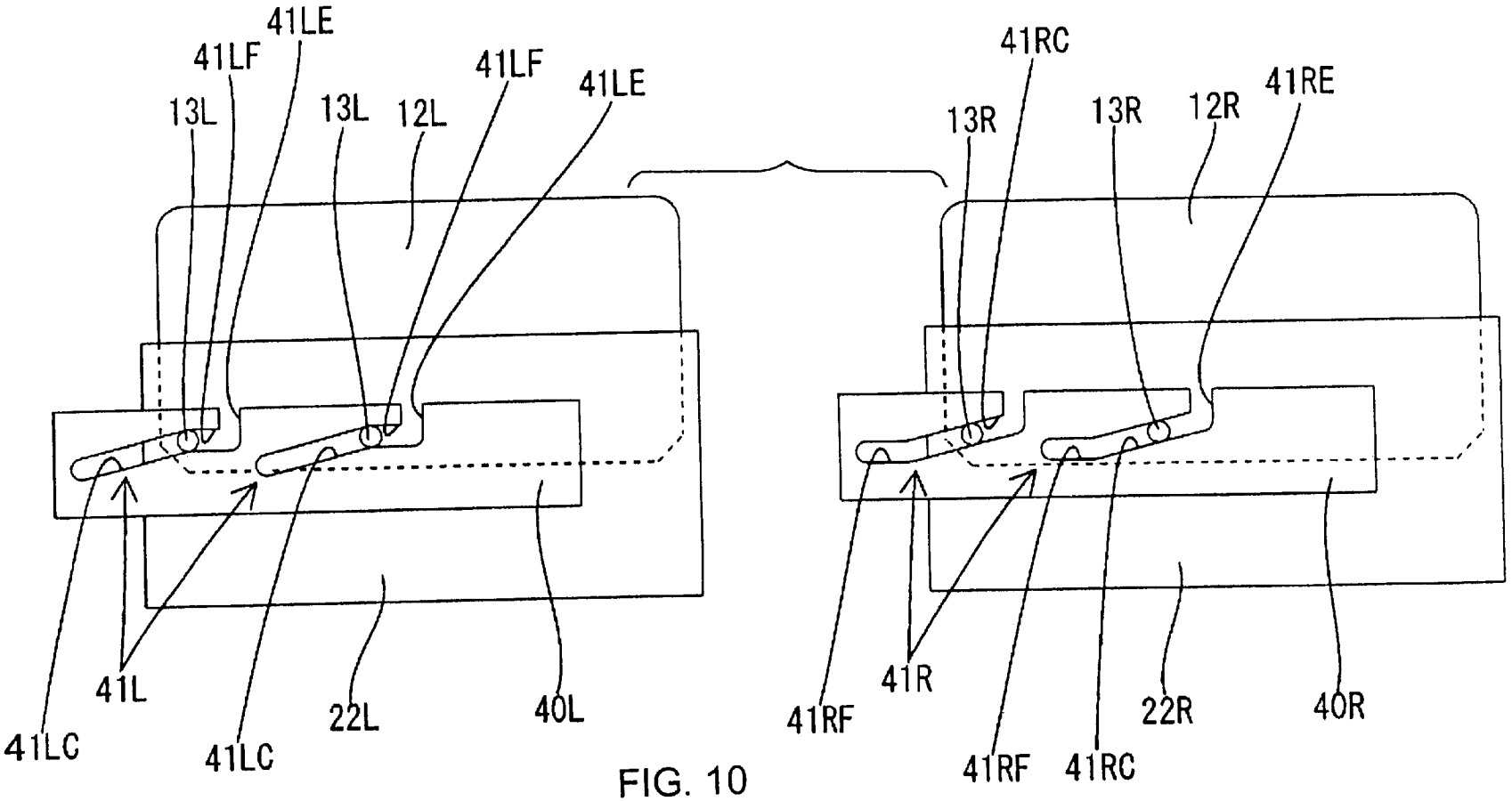
FIG. 10 is a schematic view showing cam movement and the fitting state of the partitioned housings part-way through the fitting operation.

Next, as shown in FIG. 10, when the right partitioned housing 22R has been fitted to a certain degree to the fitting member 12R, the right cam followers 13R reach the cam operating members 41RC. At this juncture, the right fitting operation continues, while simultaneously, at the left side, the left cam followers 13L are fitted into the cam operating members 41LC, this causing the left partitioned housing 22L to be fitted to the left fitting member 12L.

Figure 11:
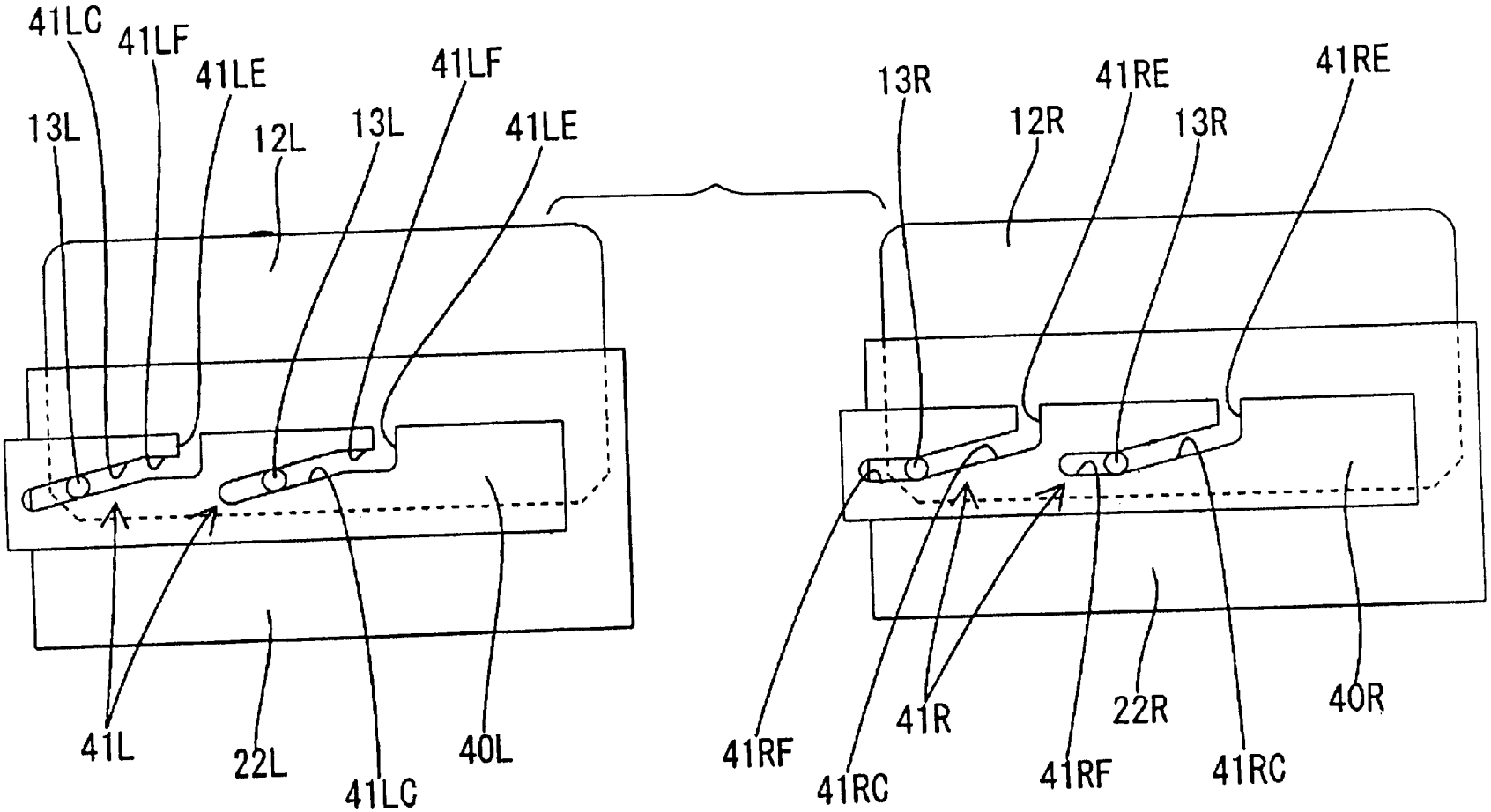
FIG. 11 is a schematic view showing cam movement and the fitting state of the partitioned housings part-way through the fitting operation.
Figure 12:
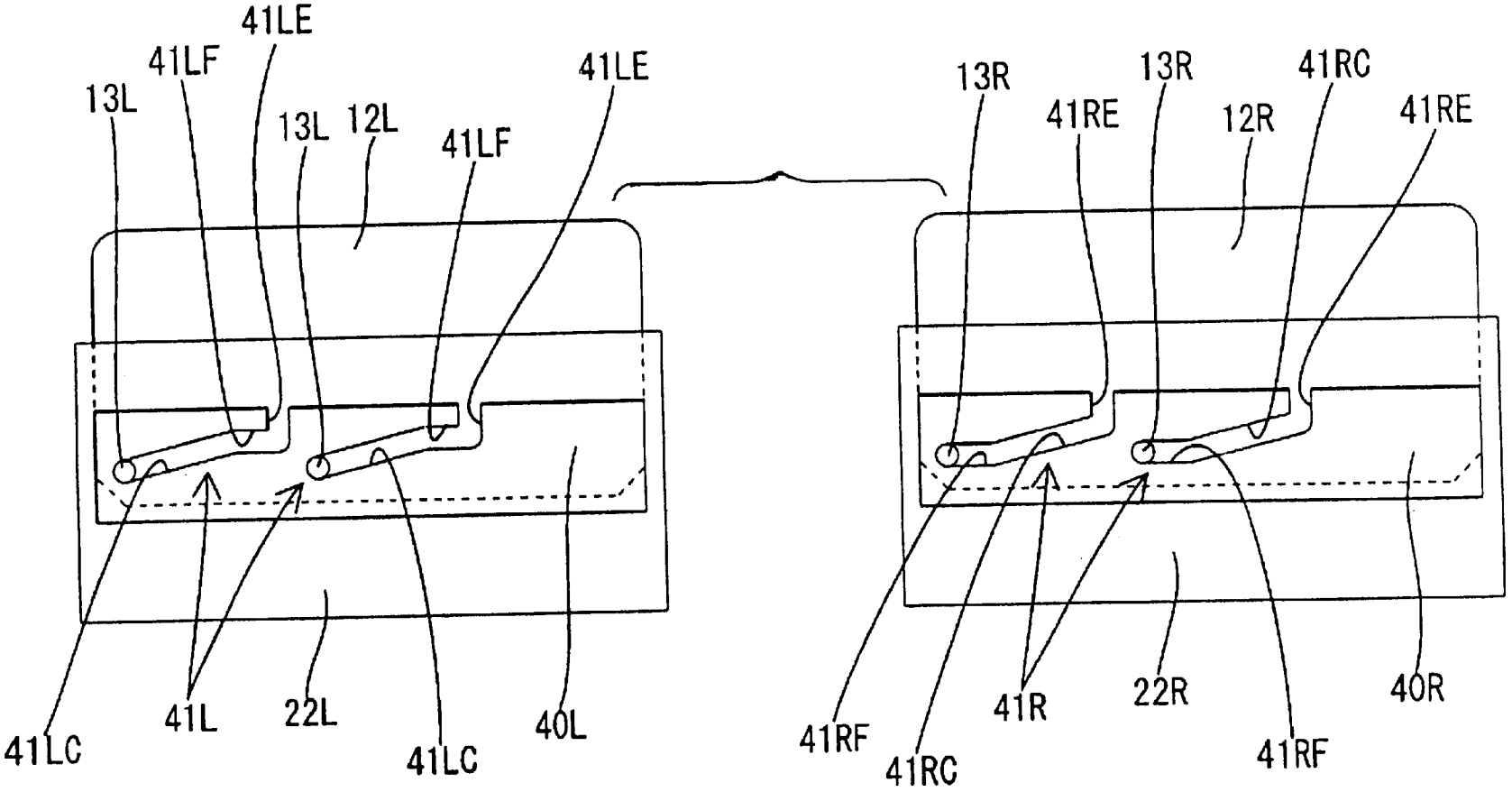
FIG. 12 is a schematic view showing cam movement and the fitting state of the partitioned housings at the end of the fitting operation.

While the fitting operation of the left partitioned housing 22L and the left fitting member 12L continues, the fitting operation of the right partitioned housing 22R and the right fitting member 12R is completed (see FIG. 11). Next, the cam followers 13R, which are positioned in the right lever 40R, move from the cam operating members 41RC to the fitting groove members 41RF, this halting the cam operation on the right side. The fitting operation, which is caused by the cam operation, now continues only on the left side. Then, the fitting operation on the left side is also completed (see FIG. 12).

The present invention is not limited to the embodiments described above with the aid of figures. For example, the possibilities described below also lie within the technical range of the present invention. In addition, the present invention may be embodied in various other ways without deviating from the scope thereof.

(1) The embodiments described above have two partitioned housings. However, the present invention is equally suitable in the case where there are three or more partitioned housings.

(2) In the embodiments described above, the second connector, which is provided with the partitioned housings, is provided with the levers, and the cam pins are provided on the first connector. However, according to the present invention, the levers may equally well be provided on the first connector, and the cam pins may be provided on the second connector.

(3) In the embodiments described above, the fitting stroke, according to which the partitioned housings are fitted with the first connector, is identical for each of the partitioned housings. However, according to the present invention, this fitting stroke may differ. In that case, even if each lever corresponding to the partitioned housings has the same shape and is moved at the same time, the timing of the fitting operation will differ for each of the partitioned housings.

What is claimed is:

1. A connector assembly comprising:

a first connector having first connector portions, a second connector having second connector portions for respective engagement with said first connector portions, a plurality of cams being provided on one of said first and second connectors, each cam corresponding with respective connector portions, cam followers being provided on the other of said first and second connectors and for co-operation with a respective cam, such that movement of the cams draws said connector portions into engagement, wherein said cams and cam followers have a different timing whereby respective connector portions are engaged in a predetermined sequence, so as to reduce the peak engagement force, and said cams and cam followers are the same, a cam control mechanism causing sequential movement of said cams.

2. A connector assembly according to claim 1 wherein said second connector portions are independently movable with respect to said second connector, said cams being movable on said second connector portions and having a control element engageable with a respective control abutment of said second connector, whereby said control abutments engage said control elements sequentially.

3. A connector assembly according to claim 2 wherein said control element comprises a follower pin and said control abutments comprise cam tracks engageable with a respective follower pin.

4. A connector according to claim 3 wherein said cams are pivotally mounted on said second connector.

5. A connector assembly according to claim 4 wherein said cams having a common pivot axis.

6. A connector assembly according to claim 4 wherein said cam pins comprise upstanding cylindrical projections having a common axis.

7. A connector assembly comprising:

a first connector having first connector portions, a second connector having second connector portions for respective engagement with said first connector portions, a plurality of cams pivotally mounted on said second connector, each cam corresponding with respective connector portions, cam followers being provided on the first connectors and for co-operation with a respective cam, such that movement of the cams draws said connector portions into engagement, wherein said cams and cam followers have a different timing whereby respective connector portions are engaged in a predetermined sequence so as to reduce the peak engagement force, said second connector portions are independently movable with respect to said second connector, said cams being movable on said second connector portions and having a control element engageable with a respective control abutment of said second connector, whereby said control abutments engage said control elements sequentially.

8. A connector assembly according to claim 7 wherein said cams having a common pivot axis.

9. A connector assembly according to claim 7 wherein said cam pins comprise upstanding cylindrical projections having a common axis.

10. A connector assembly comprising:

a first connector having first connector portions, a second connector having second connector portions for respective engagement with said first connector portions, a plurality of cams being provided on one of said first and second connectors, each cam corresponding with respective connector portions, cam followers being provided on the other of said first and second connectors and for co-operation with a respective cam, such that movement of the cams draws said connector portions into engagement, wherein said cams and cam followers have a different timing whereby respective connector portions are engaged in a predetermined sequence so as to reduce the peak engagement force, said cams define different control surfaces whereby engagement with respective cam followers is sequential, and said cams are defined by respective levers movable substantially orthogonally to the direction of engagement of said first and second connectors.

11. A connector assembly according to claim 10 wherein said levers are adapted for simultaneous movement.

12. A connector assembly comprising:

a first connector having first connector portions, a second connector having second connector portions for respective engagement with said first connector portions, a plurality of cams being provided on one of said first and second connectors, each cam corresponding with respective connector portions, cam followers being provided on the other of said first and second connectors and for co-operation with a respective cam, such that movement of the cams draws said connector portions into engagement, wherein said cams and cam followers have a different timing whereby respective connector portions are engaged in a predetermined sequence so as to reduce the peak engagement force, said cams define different control surfaces whereby engagement with respective cam followers is sequential, and said cams are pivotally mounted on said second connector.

* * * * *